US005674827A

United States Patent [19]

Kawashima et al.

[11] Patent Number: 5,674,827

[45] Date of Patent: Oct. 7, 1997

[54] DEGREASING CLEANER AND METHOD FOR CLEANING OIL-DEPOSITED MATERIAL

[75] Inventors: Riichiro Kawashima, Kanagawa; Yoshitaka Araki, Okayama; Masamichi Onuki, Kanagawa; Yukimi Fukumoto, Okayama, all of Japan

[73] Assignee: Mitsubishi Chemical Corporation, Tokyo, Japan

[21] Appl. No.: 369,493

[22] Filed: Jan. 6, 1995

[30] Foreign Application Priority Data

| | | | |
|---|---|---|---|
| Jan. 11, 1994 | [JP] | Japan | 6-001180 |
| Jan. 21, 1994 | [JP] | Japan | 6-005226 |
| Jan. 21, 1994 | [JP] | Japan | 6-005227 |
| Mar. 4, 1994 | [JP] | Japan | 6-034593 |
| Jun. 13, 1994 | [JP] | Japan | 6-130335 |

[51] Int. Cl.[6] ..... C11D 7/26; C11D 7/50; B08B 3/08

[52] U.S. Cl. ..... 510/365; 510/268; 510/245; 510/175; 510/420; 510/506; 510/505; 252/364; 134/40; 134/30; 134/26

[58] Field of Search ..... 510/268, 245, 510/175, 365, 420, 505, 506, 182, 511; 252/164, 170, 174.25, 139, 364; 134/40, 30, 26

[56] References Cited

U.S. PATENT DOCUMENTS

| | | | |
|---|---|---|---|
| 3,367,878 | 2/1968 | Mankowich | 252/110 |
| 3,679,609 | 7/1972 | Castner | 252/158 X |
| 3,761,429 | 9/1973 | Yamano et al. | 252/170 X |
| 3,829,387 | 8/1974 | Wise et al. | 252/162 X |
| 3,839,234 | 10/1974 | Roscoe | 252/170 X |
| 3,915,902 | 10/1975 | Ancel et al. | 252/162 X |
| 3,917,720 | 11/1975 | Webb et al. | 260/635 R |
| 4,193,886 | 3/1980 | Schoenholz et al. | 252/158 X |
| 4,213,873 | 7/1980 | Church | 252/170 X |
| 4,606,840 | 8/1986 | Gautier et al. | 252/170 X |
| 4,606,842 | 8/1986 | Keyes et al. | 252/173 X |
| 4,692,277 | 9/1987 | Siklosi | 252/558 |
| 5,108,660 | 4/1992 | Michael | 252/170 X |
| 5,202,050 | 4/1993 | Culshaw et al. | 252/170 |
| 5,298,182 | 3/1994 | Tsao et al. | 252/170 X |
| 5,509,969 | 4/1996 | Grawe | 134/41 X |

FOREIGN PATENT DOCUMENTS

| | | |
|---|---|---|
| 2114110 | 2/1993 | Canada . |
| 0 330 379 | 8/1989 | European Pat. Off. . |
| 0 567 015 | 10/1993 | European Pat. Off. . |
| 0 571 246 | 11/1993 | European Pat. Off. . |
| 6108092 | 4/1994 | Japan . |
| 6336600 | 12/1994 | Japan . |
| 6346094 | 12/1994 | Japan . |
| WO 93/02173 | 2/1993 | WIPO . |
| WO 94/05766 | 3/1994 | WIPO . |

OTHER PUBLICATIONS

Mellan, Ibert, Industrial Solvents Handbook, 2nd ed., Noyes Data Corporation, pp. 235, 236, 254–274, 282–284, 293–295, and 367. (Month is unknown.) 1977.

Database WPI, Derwent Publications, AN 76–19493, JP–A–51 010 808, Jan. 28, 1976.

Chemical Abstracts, vol. 115, No. 10, Sep. 9, 1991, Kitazawa, "Cleaning Compositions for Electronic Parts".

Database WPI, Derwent Publications, AN 86–055671, AU–A–4 456 385, Jan. 9, 1986.

*Primary Examiner*—Douglas J. McGinty

*Attorney, Agent, or Firm*—Oblon, Spivak, McClelland, Maier & Neustadt, P.C.

[57] ABSTRACT

A degreasing cleaner composition, which can efficiently remove oil from an oil-deposited material to be cleaned containing:

(A) 40 to 95% by weight based on total composition weight of at least one alcoholic compound selected from the group consisting of (a) a water-soluble polyol having 4 to 10 carbon atoms and at least two hydroxyl groups, (b) a water-soluble monoalkyl ether compound in which one hydrogen atom of the hydroxyl groups of the (a) polyol having 4 to 10 carbon atoms is substituted by an alkyl group having 1 to 5 carbon atoms, (c) a water-soluble monoacyl ether compound in which one hydroxyl group of the (a) polyol having 4 to 10 carbon atoms is substituted by an acyl group having 1 to 5 carbon atoms, and (d) 4-methyl-4-hydroxy-2-pentanone, and (B) 5 to 60% by weight based on total composition weight of water.

14 Claims, 2 Drawing Sheets

DEGREASING CLEANER AND METHOD FOR CLEANING OIL-DEPOSITED MATERIAL

FIELD OF THE INVENTION

The present invention relates to a degreasing cleaner and a method for cleaning an oil-deposited material. The invention cleaner effectively removes grease and oil deposited on a material to be cleaned, such as a metal part.

BACKGROUND OF THE INVENTION

In the fabrication of metal parts such as precision instrument parts and electric parts cutting oil and the like are used to reduce the friction between materials to be cut-worked and cutting tools. Cutting oil removes a great amount of the friction heat generated upon fabrication, washes out cutting wastes, prolongs the working life of cutting tools and smooths finished surfaces. The oil is therefore commonly deposited on fabricated metal materials.

In many cases, however, such oil-coated materials cannot be supplied as finished products. For this reason, in a finishing step for such parts, the oil is usually removed by cleaning with organic solvents. Known organic solvents which have hitherto been used for removal of such oil by cleaning include hydrocarbon solvents such as kerosene, benzene and xylene, chlorine solvents such as trichloroethylene and tetrachloroethylene, and flon solvents such as trichlorotrifluoroethane. In particular, the flon or chlorine solvents having high cleaning ability and incombustibility have been used for cleaning of, e.g., electronic, electric or machinery parts.

However, of the conventional organic solvents described above, the hydrocarbon solvents, particularly benzene and xylene, are highly toxic and specified by various governments as being deleterious materials in view of labor safety laws. Accordingly, risk and complexity problems arise in designing operations for handling them. Further, the above-mentioned chlorine or flon solvents have serious problems in terms of safety, toxicity and environmental pollution.

Previously, many cleaner compositions containing various ingredients as mixtures have been proposed. However, it is still necessary to develop an optimum cleaner which provides a high required degree of cleaning. For example, cleaners containing ethylene glycol, propylene glycol or alkyl ethers thereof have recently been made commercially available in place of chlorine or flon solvents. However, these cleaners provide insufficient degreasing and are impossible to use repeatedly because of the dissolution of oil into the cleaners during cleaning.

SUMMARY OF THE INVENTION

It is therefore an object of the present invention to provide a degreasing cleaner comprising a water-soluble polyol, a monoalkyl ether thereof or a monoacyl ether thereof, and water, which provides excellent degreasing cleaning ability for oil, shows satisfactory safety and sanitation for working circumstances, and avoids environmental pollution.

Another object of the present invention is to provide a method for effectively removing oil from a material to be cleaned on which oil is deposited by use of the invention degreasing cleaner.

According to a first aspect of the present invention, there is provided a degreasing cleaner composition comprising (A) 40 to 95% by weight based on the total weight of the composition of at least one alcoholic compound selected from the group consisting of (a) a water-soluble polyol having 4 to 10 carbon atoms and at least two hydroxyl groups, (b) a water-soluble monoalkyl ether compound in which one hydrogen atom of the hydroxyl groups of the (a) polyol having 4 to 10 carbon atoms is substituted by an alkyl group having 1 to 5 carbon atoms, (c) a water-soluble monoacyl ether compound in which one hydroxyl group of the (a) polyol having 4 to 10 carbon atoms is substituted by an acyl group having 1 to 5 carbon atoms, and (d) 4-methyl-4-hydroxy-2-pentanone, and (B) 5 to 60% by weight based on the total weight of the composition of water.

According to a second aspect of the present invention, a method is provided for cleaning an oil-deposited material or work-piece to remove oil therefrom using the above-mentioned degreasing cleaner.

DETAILED DESCRIPTION OF THE INVENTION

Figure 1:
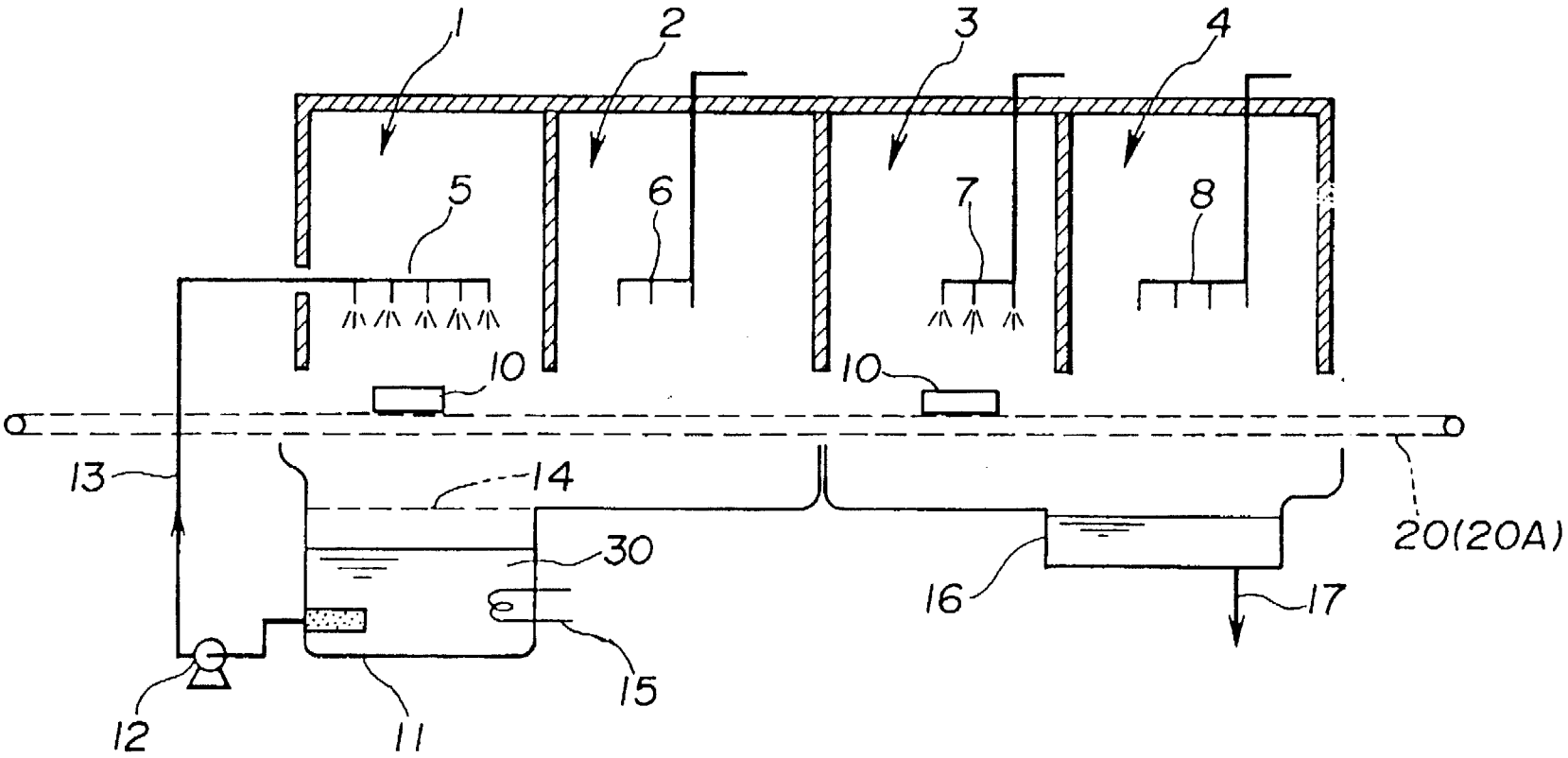
FIG. 1 is a cross sectional view showing one embodiment of an apparatus for cleaning an oil-deposited material.

The ingredient (a) water-soluble polyols having 4 to 10 carbon atoms each has at least two, preferably 2 to 4, alcoholic hydroxyl groups per molecule. Examples thereof include 1,2-butanediol, 1,3-butanediol, 1,4-butanediol, 1,2,3-butanetriol, 2-methyl-2,4-pentanediol, 1,2-cyclohexanediol, 1,2,3-cyclohexanetriol, 1,2-hexanediol, 1,3-hexanediol, 1,2,3-hexanetriol, 1,2,3,4-hexanetetraol, 1,2-octanediol, 1,2,3-octanetriol, 1,3-octanediol, 1,2-decanediol and 1,2,3-decanetriol. Preferred examples thereof include 1,2-butanediol, 2-methyl-2,4-pentanediol and 1,2-hexanediol.

Ingredient (b) monoalkyl ether compounds include 1-methoxy-2-butanol, 2-methoxy-1-butanol, 1-ethoxy-2-butanol, 2-ethoxy-1-butanol, 1-butoxy-2-butanol, 2-butoxy-1-butanol, 1-propoxy-2-butanol, 2-propoxy-1-butanol, 4-methyl-4-methoxy- 2-pentanol, 4-methyl-4-ethoxy-2-pentanol and 4-methyl-4-propoxy-2-pentanol. Preferred examples thereof include 1-propoxy-2-butanol, 1-methoxy-2-butanol and 1-tert-butoxy-2-butanol.

Further, ingredient (c) monoacyl ether compounds include 1-acetoxy-2-butanol, 2-acetoxy-1-butanol and 4-acetoxy-1-butanol.

Further examples of these water-soluble alcoholic compounds (a) to (d) are represented by the following formulas (I) to (III):

$$R^1O—CH_2CH_2CH_2CH_2—OR^2 \quad (I)$$

wherein $R^1$ and $R^2$ each independently represents a hydrogen atom, an acyl group having 1 to 5 carbon atoms, an alkyl group having 1 to 5 carbon atoms or an alkenyl group having 3 to 5 carbon atoms; and at least one of them is a hydrogen atom.

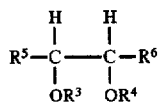

(II)

wherein $R^3$ and $R^4$ each independently represents a hydrogen atom, an acyl group having 1 to 4 carbon atoms or an alkyl group having 1 to 4 carbon atoms; at least one of them is a hydrogen atom; $R^5$ and $R^6$ each independently represents a hydrogen atom or an alkyl group having 1 to 4 carbon atoms; and the sum of the carbon numbers of $R^5$ and $R^6$ is 2 or more.

$$R^7—CH_2—C(CH_3)_2—OR^8 \quad (III)$$

wherein $R^7$ represents $R^9CO$ or $R^9CH(OH)$; and $R^8$ and $R^9$ each represents a hydrogen atom or an alkyl group having 1 to 5 carbon atoms.

All of the above-mentioned alcoholic compounds may be used in the invention composition alone or in combination. Preferably, the use of a mixture comprising 35 to 90% by weight based on the total weight of the degreasing cleaner, preferably 55 to 85% by weight, of at least one water-soluble polyol having 4 to 10 carbon atoms described in ingredient (a), and 5 to 50% by weight, based on the total weight of the degreasing cleaner, preferably 10 to 40% by weight, of at least one alcoholic compound selected from the compounds described in ingredients (b), (c) and (d) (with the proviso that the sum of the polyol (a) and the other alcoholic compound(s) is 40 to 95% by weight) can improve the solubility of the polyol in water to significantly enhance the degreasing cleaning effect.

In the degreasing cleaner composition of the present invention, the content of ingredient (A), the alcoholic compound(s), is 40 to 95% by weight, preferably 50 to 90% by weight, and more preferably 60 to 85% by weight, based on total weight, while the content of ingredient (B), water, is 5 to 60% by weight, preferably 10 to 50% by weight, and more preferably 15 to 40% by weight based on total weight.

The optimum composition of the invention degreasing cleaner can vary depending upon the properties of the oil to be removed. However, if the water content is within the above-mentioned range, degreased oil tends to float and separate without dissolution thereof after degreasing treatment, so that the cleaner can be repeatedly used several times and for a long period of time with no necessity for entire recovery or periodical replacement of the cleaner. In particular, the cleaner does not ignite fire at a water content of about 15% by weight or more. It is thus therefore preferred that the cleaner contain about 15% by weight or more of water since it can then be handled as a non-dangerous material. When the water content in the invention cleaner is less than 5% by weight, the solubility of oil in the cleaner is increased after repeatedly using it, which tends to lower the degreasing cleaning effect. A water content of more than 60% by weight in the cleaner results in significantly decreased degreasing cleaning effect.

The degreasing cleaners of the present invention may contain other solvents in small amounts as long as they do not adversely affect the cleaner to an undesirable degree. The other solvents include ethers, esters, aromatic hydrocarbons and alicyclic hydrocarbons. Further, in order to improve the cleaning effect, the cleaners may contain salts of alkali metals or alkaline earth metals, organic amines and surface active agents in some cases. In addition, known antioxidants, rust proof agents and thickeners may also be added.

In the cleaners of the present invention, it is also possible to improve the oil eliminating effect and to attain enhanced cleaning effects by blending in alkali compounds in small amounts. In this case, the blending amount of such alkali compounds is usually 0.01 to 1% by weight based on the total weight of the cleaner, and preferably 0.03 to 0.5% by weight. The alkali compounds to be blended include organic amines or organic ammonium salts, as well as hydroxides, carbonates and acetates of alkali metals or alkaline earth metals.

Specifically, examples of inorganic salts of alkali metals include carbonates such as sodium carbonate, sodium hydrogencarbonate, potassium carbonate and lithium carbonate, silicates such as sodium silicate, potassium silicate, sodium methasilicate and sodium orthosilicate, phosphates such as sodium phosphate, potassium phosphate, sodium tripolyphosphate and sodium pyrophosphate, borates such as sodium 4-borate and potassium 4-borate, sulfates such as sodium sulfate and potassium sulfate, nitrates such as sodium nitrate, and chlorides such as lithium chloride and sodium chloride. Examples of inorganic salts of alkaline earth metals include carbonates such as calcium carbonate and magnesium carbonate, silicates, phosphates, borates, sulfates, nitrates, chlorides, etc.

Examples of salts of alkali metals or alkaline earth metals include organic salts such as sodium formate, sodium acetate, potassium oxalate, sodium benzoate and sodium p-toluenesulfonate, in addition with inorganic salts.

Examples of hydroxides of alkali metals include sodium hydroxide, potassium hydroxide, etc. Examples of hydroxides of alkaline earth metals include calcium hydroxide, etc.

Examples of organic amines include water-soluble amines having an alkyl group having 1 to about 6 carbon atoms, such as methylamine, ethylamine, isopropylamine, diethylamine, triethylamine, ethylenediamine, tetramethylethylenediamine, cyclohexylamine. Alkanolamines also can be used preferably. Examples of alkanolamines include ethanolamine, diethanolamine, triethanolamine, N-methyldiethanolamine, 2-methylaminoethanol, etc. These organic amines may be used individually or as a mixture of two or more of them.

Examples of organic ammonium salts usually include alkylammonium compound having 1 to 6 carbon atoms. Specific examples of organic ammonium salts includes hydroxides, sulfates, sulfites, paratoluenesulfonates, nitrates, acetates, halides of tetramethylammonium or tetraethylammonium, etc. Sulfates, nitrates, acetates, halides of ammonia, etc. can also be used.

The oil-deposited materials to be cleaned with the degreasing cleaners of the present invention include precision parts such as electronic parts, electric parts, precision instrument parts, resin fabrication parts and optical parts, metal parts such as machine parts, automobile parts and jigs and tools used for assembling and fabrication steps, etc. Examples of the electronic parts include printed circuit substrates, IC lead frames, capacitors, liquid crystal display devices and semiconductor materials. Examples of the electric parts include parts such as motor cores, and electric motor parts such as magnets, brushes and housings. Examples of the precision instrument parts include bearings, sewing machine parts and parts for fabrication. Examples of the optical parts include lenses. Examples of the machine parts include bearings, gears and various kinds of other machine parts. Examples of the automobile parts include engine parts, transmission gears and carburetors. In addition, examples of the jigs and tools used for assembling and fabricating such parts include jigs and tools used in various kinds of steps such as manufacturing, forming, fabrication, assembling and finishing of the precision parts described above. The oil deposited on the materials to be cleaned includes oils and fats, machine oil, cutting oil and grease.

The cleaning of the oil-deposited materials according to the present invention is conducted by washing (i.e., soaking, contacting, etc.) the oil-deposited materials to be cleaned with the above-mentioned cleaners, then optionally scrubbing, etc. and optionally blowing gas on the materials to be cleaned to partially remove the cleaners deposited thereon, and optionally subsequently washing the materials with water or steam, or optionally washing the materials with water followed by washing with steam. Specifically, the oil-deposited materials can be cleaned by the following methods.

In a first step, the oil-deposited materials to be cleaned are cleaned with the cleaners of the present invention by various cleaning methods such as soaking methods, ultrasonic cleaning methods, vibrating methods and spraying methods, usually at 20° to 100° C., preferably at 40° to 80° C., to remove oil deposited on the material to be cleaned.

In employing the soaking methods in the cleaning for decreasing, air or nitrogen may be passed through the cleaner to cause bubbling, thereby further enhancing the cleaning effect. Bubbles can be easily formed by blowing gas such as air or nitrogen into the cleaners during cleaning. The blowing amount of the gas is usually about 0.2 to about 20 Nl/minute per liter of cleaning solution, but it may be properly controlled depending on the desired cleaning effect and the evaporation, if any, of water. The time required for cleaning is usually several minutes to several tens of minutes.

The exertion of the physical action of bubbles, that is, the stirring action of the cleaning solutions and the physical separating action to the deposited oil by means of the bubbles remarkably improves the cleaning effect. Further, the bubbles also have the effect of rapidly moving the oil separated from the materials to be cleaned to surfaces of the cleaning solutions (the dissolving power of the cleaning solutions used in the present invention on the oil is low, and the cleaning action exclusively depends on the separation of the deposited oil from the materials to be cleaned). Accordingly, the separated oil floats as oil droplets in the cleaning solutions.

The separated oil floating on the surface of the cleaning solution can be removed by appropriately overflowing together with a part of the cleaner, or by using an oil skimmer device, etc.

Further, in the soaking methods, if the oil deposited on the materials to be cleaned is a highly viscous oil, for example, having a dynamic viscosity at 40° C. ranging from 50 to 2,000 centistokes, particularly ranging from 100 to 1,000 centistokes, such as press oil, drawing oil or heat treatment oil, it is particularly effective to conduct ultrasonic cleaning. There is no particular restriction on the conditions of ultrasonic cleaning, and any ultrasonic generator generally employed may be used. The ultrasonic vibration frequency is usually set to 10 to 100 kHz, and preferably to 15 to 50 kHz.

Then, in a second step, the cleaner deposited on the materials to be cleaned after oil cleaning are optionally eliminated by physical means. As the physical means for eliminating the cleaners, it is preferred, for example, to blow gas, most simply air, nitrogen gas or carbon dioxide gas, on the materials to be cleaned to blow off the deposited cleaners, thereby removing them. The blowing speed or the blowing time of the gas may be selected depending on the shape of the materials to be cleaned, the permissible residual amount of the deposited cleaning solutions, and the like. Further, instead of gas blowing, centrifugal force can also be exerted on the materials to be cleaned, thereby eliminating the cleaners. The cleaners thus eliminated may be recovered and supplied to cleaning vessels.

By the method described above, the cleaners may be recovered to reduce the loss of the cleaners caused by cleaning to as low a level as possible, and the amount of the cleaners dissolved by water washing in the optional subsequent step is decreased as low as possible, thereby reducing the burden of waste water treatment. In this case, the gas is blown in such an amount that the cleaners deposited on the materials to be cleaned are blown off for a short period of time (1 $m^3$/hour or more), and the amount varies depending on the shape and the size of the materials to be cleaned. The cleaners can be effectively eliminated by increasing the linear velocity of the gas at a gas nozzle.

In a third optional step, the cleaners still remaining on the surfaces of the materials to be cleaned which have been subjected to treatment using the above-mentioned cleaners are removed by water washing or steam washing. It is difficult to completely remove by evaporation the cleaners slightly remaining on the surfaces of the materials to be cleaned merely by blowing the gas. For this washing, various washing methods such as soaking methods, ultrasonic methods, vibrating methods and spraying methods can be used.

For the water washing, there are generally used the method of soaking the materials to be cleaned into water contained in a water washing vessel and the method of injecting water recycled by a pump to the materials to be cleaned. Water is preferably used at room temperature or at elevated temperatures. In particular, it is preferred to heat the water to 40° to 80° C. As the water washing vessel, one vessel is usually employed. However, a plurality of vessels may be arranged in series if required. In that case, washing water may be supplied to each of the vessels. However, it is preferred that water moves in countercurrent to the materials to be cleaned in each of the water washing vessels in the usual manner.

It is preferred to blow gas such as air, nitrogen or carbon dioxide gas into the water washing vessel to allow bubbles to move upward in the vessel in the same manner as with the cleaning vessel. This stirs water contained in the vessel to promote the removal of the cleaners deposited on the materials to be cleaned and also the evaporation of water in the vessel, whereby water balance can be easily established over the entire cleaning system.

Further, in some cases, the optional method of blowing steam on the degreased materials, thereby blowing off the cleaners deposited thereon to remove them, can also be employed as the water washing method. This method can decrease the amount of water used and reduce the burden of waste water treatment, compared with the water washing method of soaking the materials to be cleaned into washing water. In this case, the blowing amount and the blowing speed of steam are preferably selected so that the cleaners deposited on the materials to be cleaned are blown off and removed for a short period of time. It is preferred that the temperature of steam is usually 100° to 130° C., and that the blowing amount of the steam is usually about 60 to about 6,000 kg/hour per $m^2$ of surface area of material to be cleaned.

In this water washing step, in order to prevent the cleaner ingredients from being accumulated in water, fresh water is always supplemented, and water containing the cleaner is partially extracted from the water washing vessel as washing waste water. The extracted washing waste water may be supplied at least partially, preferably entirely to the cleaning vessel as replenishing water. Namely, water is partially lost by evaporation, etc. from the cleaning vessel. It is therefore necessary to replenish water externally in order to maintain the composition of the cleaner constant. As the replenishing water, washing waste water generated in the water washing step can be utilized. This can prevent the loss of the cleaner ingredients and reduce or avoid the burden of waste water treatment. The concentration administration of the cleaners can be easily carried out based on measurements of physical properties such as refractive index and density obtained by usual instrumental analysis for the cleaners.

For the materials to be cleaned after water washing, water deposited on the surfaces thereof is optionally removed by drying. Examples of the methods for removing water by drying include gas blowing, air drying, vacuum drying and infrared irradiation methods. Of these methods, gas blowing is preferred as a method for removing water by drying for a short period of time. According to this method, water is removed by blowing gas such as air or nitrogen at room temperature or elevated temperatures to blow off water. In this case, the blowing amount of the gas may be enough so long as water deposited on the materials to be cleaned is blown off and removed in a short period of time. Although the amount can not be defined generally because it varies depending on the shape and the size of the materials to be cleaned, it is effective to increase the linear velocity of the gas at a gas nozzle.

The method for cleaning the oil-deposited materials according to the present invention can be easily conducted with cleaning apparatuses shown below. The apparatuses for cleaning the oil-deposited materials are illustrated in detail below with reference to the drawings.

Figure 2:
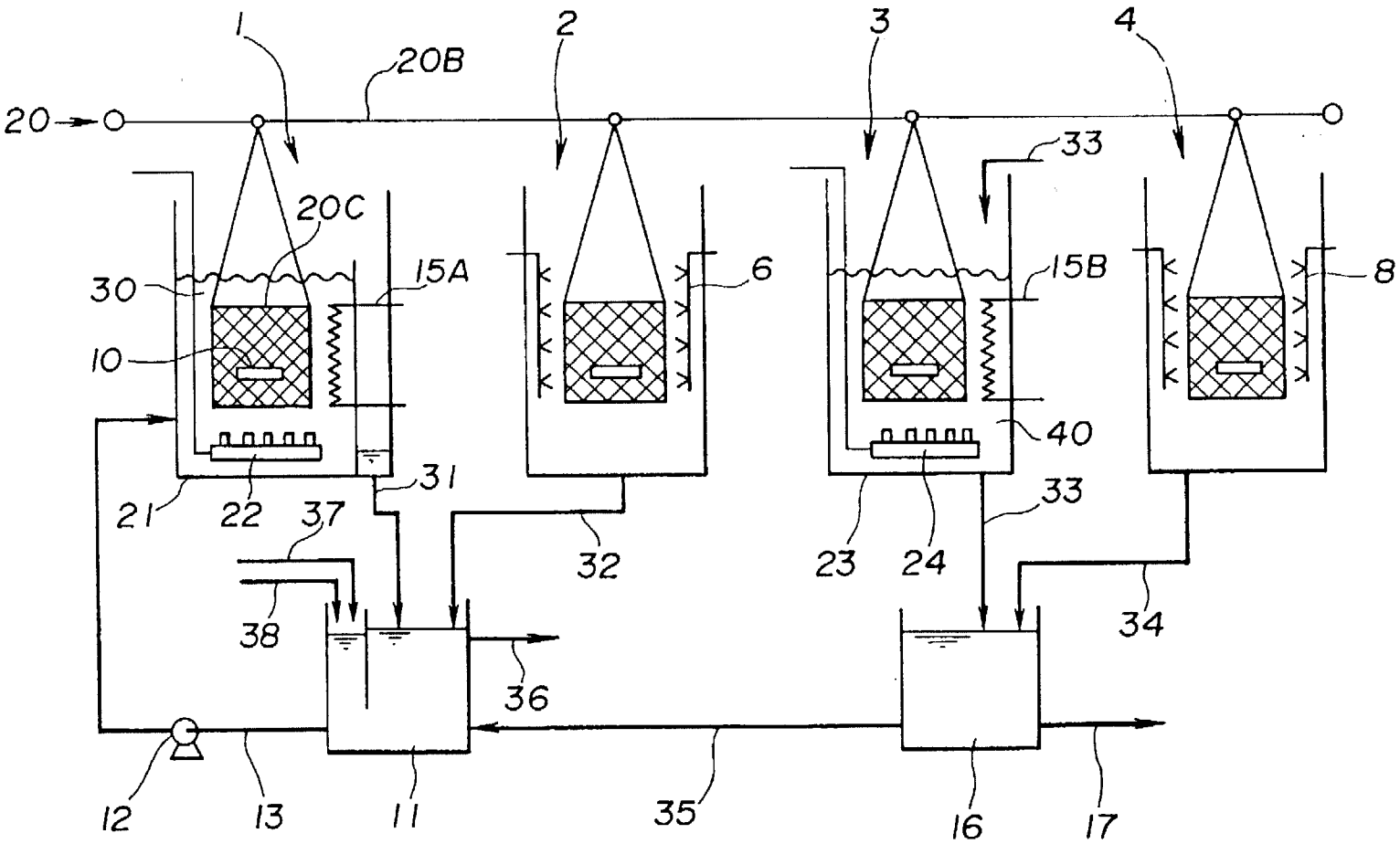
FIG. 2 is a cross sectional view showing another embodiment of an apparatus for cleaning an oil-deposited material.

FIGS. 1 and 2 are cross sectional views showing embodiments of apparatuses for cleaning oil-deposited materials.

Each of the apparatuses shown in FIGS. 1 and 2 mainly comprises an oil-cleaning section 1 for cleaning materials to be cleaned 10 on surfaces of which oil is deposited with a cleaner 30; a gas-blowing section 2 for blowing off the cleaner deposited on the materials to be cleaned which have passed through the oil-cleaning section 1 with gas, thereby removing the cleaner; a water washing section 3 for removing the cleaner remaining on the surfaces of the materials to be cleaned which have passed through the gas-blowing section 2 by water washing treatment; a gas-blowing drying section 4 for blowing off water deposited on the materials to be cleaned which have passed through the water washing section 3 by gas blowing, thereby removing water; and a transporting device 20 (comprising a belt conveyor 20A and a lift 20B) for transporting the materials 10 to be cleaned through the oil-cleaning section 1, the gas-blowing section 2, the water washing section 3 and the gas-blowing drying section 4.

In the cleaning apparatus shown in FIG. 1, reference numeral 5 designates a spray nozzle for the cleaner 30, and cleaner 30 in cleaner recovery vessel 11 disposed below the oil-cleaning section 1 and the gas-blowing section 2 is supplied thereto by way of a pipeline 13 provided with a pump 12. A filter 14 is disposed above the cleaner recovery vessel 11 for the purpose of preventing dust etc. together with the cleaner used for cleaning the material 10 from being introduced into the cleaner recovery vessel 11. Further, the cleaner recovery vessel 11 is provided with a heater 15 for heating the cleaner to appropriate temperatures. The reference numerals 6 and 8 designate gas nozzles, which are constructed in such a manner that gas such as air or nitrogen is blown toward the material 10 to be cleaned. The reference numeral 7 designates a spray nozzle for washing water. Washing water sprayed from this spray nozzle 7 is recovered by a washing waste water recovery vessel 16 disposed below the water washing section 3 and the gas-blowing drying section 4, and supplied to a waste water treating step through a pipeline 17.

According to this cleaning apparatus, the material 10 to be cleaned is supplied onto the belt conveyor 20A, and successively transported rightward in the drawing by the belt conveyor 20A. That is, the material 10 to be cleaned first enters the oil-cleaning section 1, in which the heated cleaner 30 of the present invention is sprayed on the material 10 through the spray nozzle 5, thereby removing the oil deposited on the material 10. Then, the cleaner deposited on the surface of the material 10 to be cleaned is blown off by the gas jetted from the gas nozzle 6 during passage thereof through the gas-blowing section 2, thereby removing most of the cleaner. An excess of the cleaner in the oil-cleaning section 1 and the cleaner removed in the gas-blowing section 2 are recovered in the cleaner recovery vessel 11 and recycled for reuse. Further, since the degreased oil floats on a surface of a cleaning solution in the cleaner recovery vessel 11, the oil separated and floating on the surface of the cleaning solution may be appropriately overflowed together with a part of the cleaner, or separated and removed using an oil skimmer device, etc.

Then, the material 10 to be cleaned is transported to the water washing section 3, in which water (particularly, purified water when precision parts, etc. are cleaned) is sprayed from the water spray nozzle 7 to the material 10, thereby removing the remaining cleaner. Subsequently, during passage of the material 10 to be cleaned through the gas-blowing drying section 4, water deposited on the surface thereof is almost all blown off by the gas jetted from the gas nozzle 8, thereby removing water. The material 10 which has passed through and taken out of the gas-blowing drying section 4 is completely dried throughout it. Washing waste water produced in the water washing section 3 and water removed in the gas-blowing drying section 4 are recovered in the washing waste water recovery vessel 16, and supplied to the waste water treating step.

In the cleaning apparatus shown in FIG. 2, the reference numeral 21 designates a cleaning vessel in which the material 10 to be cleaned placed in a wire cage 20C of the lift 20B is suspended to clean it by soaking. This cleaning vessel 21 is provided with a heater 15A for heating the cleaner 30 contained therein to appropriate temperatures and a gas nozzle 22 for supplying gas such as air or nitrogen to the cleaner 30 for bubbling. Further, the cleaner 30 contained in a cleaner recovery vessel 11 disposed below the gas-blowing section 2 is supplied to this cleaning vessel 21 through a pipeline 13 provided with a pump 12. The cleaner recovery vessel 11 may also be provided with a heater 15 for heating the cleaner 30 to appropriate temperatures, if necessary. The reference numerals 6 and 8 designate gas nozzles, which are constructed in such a manner that gas such as air or nitrogen is blown toward the material 10 to be cleaned. The reference numeral 23 designates a washing water reservoir in which the material 10 to be cleaned is washed by soaking and which is provided with a spray nozzle 7 for washing water at an upper portion thereof and a heater 15B for heating washing water 40 contained in the reservoir to appropriate temperatures.

This washing water reservoir 23 is also provided with a gas nozzle 24 for supplying gas such as air or nitrogen to the washing water contained therein for bubbling. A washing waste water recovery vessel 16 is disposed below the gas-blowing drying section 4, and recovers water blown off by gas blowing and excess water from the washing water reservoir 23 through a pipeline 17. An excess of the cleaner in the oil-cleaning section 1 and the cleaner removed in the gas-blowing section 2 are recovered in the cleaner recovery vessel 11 and recycled for reuse.

According to the cleaning apparatus shown in FIG. 2, the material 10 to be cleaned is placed in the wire cage 20C of the lift 20B, and successively transported rightward in the drawing by the lift 20B. That is, the material 10 to be cleaned is first enters the oil-cleaning section 1. Then, the wire cage 20C is lowered in the cleaner reservoir 21, and soaked in the heated cleaner 30 to clean the material 10 under bubbling. The wire cage 20C is once elevated, and the material 10 from which the deposited oil is removed by soaking cleaning is taken out of the cleaner reservoir 21. Subsequently, the cleaner deposited on the surface thereof is blown off by gas such as air or nitrogen jetted from the gas nozzle 6 during passage thereof through the gas-blowing section 2, thereby removing most of the cleaner. An excess of the cleaner in the oil-cleaning section 1 and the cleaner removed in the gas-blowing section 2 are recovered through pipelines 31 and 32, respectively, in the cleaner recovery vessel 11 and recycled for reuse.

Then, the material 10 to be cleaned is transported to the water washing section 3, in which the wire cage 20C is lowered and soaked in the heated washing water 40 to wash the material 10 with water under bubbling. The wire cage 20C is elevated, and the material 10 from which the residual cleaner is removed by water washing is taken out. Subsequently, during passage of the material 10 through the gas-blowing drying section 4, water deposited on the surface thereof is almost all blown off by the gas jetted from the gas nozzle 8, thereby removing water. The material 10 which has passed through and taken out of the gas-blowing drying section 4 is completely dried throughout it. Further, excess waste water from the water washing section 3 and waste water removed in the gas-blowing drying section 4 are recovered through pipelines 33 and 34, respectively, in the waste water recovery vessel 16, and taken out of the system through the pipeline 17.

Referring more specifically to the cleaner recovery vessel 11, when the cleaner used for cleaning is recovered in the cleaner recovery vessel 11, the oil degreased from the material 10 to be cleaned floats near a surface of a recovered solution in view of its specific gravity. The oil can therefore be removed out of the system through a pipeline 36. On the other hand, the cleaner solution from which the oil has been separated is supplied to the cleaning vessel 21 through the pipe 13. A cleaner and water for replenishing (if necessary) are also introduced into the cleaner recovery vessel 11 through pipelines 37 and 38. The cleaner recovery vessel 11 is preferably provided with a partition therein so that the cleaner and water for replenishing are not mixed with the recovered oil, as shown in FIG. 2. Further, washing waste water in the waste water recovery vessel 16 is introduced into the cleaner recovery vessel 11 through the pipeline 35, depending on the required amount.

In the cleaning apparatuses shown in FIGS. 1 and 2, degreasing or washing with water is not restricted to spray cleaning (washing) or cleaning (washing) by soaking, but the other cleaning or washing methods described above may also be used. Further, the device for transporting the material to be cleaned is not restricted to the belt conveyor and the lift, but a driving roll, a caterpillar, etc. can be employed. Furthermore, the transporting device is preferably constructed so that it is permeable to the cleaner and water. For example, in the case of the belt conveyor, it is advantageous to use a belt conveyor made of a mesh or a perforated material, and in the case of the lift, it is advantageous to use a wire gage or a wire tray.

The present invention will be described in more detail with reference to the following Examples and Comparative Examples, but the present invention is not to be construed as being limited thereto.

EXAMPLE 1

A degreasing cleaner composed of a mixed solution of 80% by weight of 1,2-butanediol and 20% by weight of water was placed in a 500-ml cleaning vessel having an air blowing pipe at a bottom portion thereof, and heated at 60° C.

A material to be cleaned, a test piece made of chrome stainless steel (having a surface area of 33 $cm^2$) coated with 320 mg of heat treatment oil, was soaked in the degreasing cleaner placed in the cleaning vessel, and air was blown therein at 0.5 Nl/min.$cm^2$ through the air blowing pipe. After 10 minutes, the test piece was taken out of the cleaning vessel, and air was blown thereon, followed by soaking in 300 ml of water for 1 minute. Then, the test piece after cleaning was soaked in 100 ml of carbon tetrachloride, and subjected to ultrasonic treatment for 5 minutes to extract oil remaining on a surface of the test piece. The oil was analyzed with an infrared spectrophotometer to determine the amount of residual oil. As a result, the amount of residual oil was 23 μg/$cm^2$.

EXAMPLE 2

The cleaning test was conducted in the same manner as in Example 1 with the exception that a test piece made of chrome stainless steel which was coated with 320 mg of cutting oil was used. As a result, the amount of residual oil was 15 μg/$cm^2$.

EXAMPLE 3

The cleaning test was conducted in the same manner as in Example 1 with the exception that 300 ml of a mixed solution of 30% by weight of 1,2-butanediol, 40% by weight of 1-propoxy-2-butanol and 30% by weight of water was used as a degreasing cleaner and the test piece was cleaned with stirring for 5 minutes. As a result, the amount of residual oil was 6 μg/$cm^2$.

EXAMPLE 4

The cleaning test was conducted in the same manner as in Example 3 with the exception that the cleaning temperature was changed to 40° C. in stead of 60° C. As a result, the amount of residual oil was 8 μg/$cm^2$.

EXAMPLE 5

The cleaning test was conducted in the same manner as in Example 3 with the exception that 300 ml of a mixed solution of 30% by weight of 1,2-butanediol, 50% by weight of 1-propoxy-2-butanol and 20% by weight of water was used as a degreasing cleaner. As a result, the amount of residual oil was 4 μg/$cm^2$.

EXAMPLE 6

A degreasing cleaner composed of a mixed solution of 80% by weight of 1,4-butanediol and 20% by weight of water was placed in a 500-ml cleaning vessel having an air blowing pipe at a bottom portion thereof, and heated at 60° C.

A test piece made of chrome stainless steel (having a surface area of 33 $cm^2$) coated with 320 mg of heat treatment oil was soaked in the degreasing cleaner placed in the cleaning vessel, and air was blown therein at 5 Nl/min (0.5 Nl/min.$cm^2$) through the air blowing pipe. After 10 minutes, the test piece was taken out of the cleaning vessel, and air was blown thereon, followed by soaking in 300 ml of water for 1 minute. Then, the test piece after cleaning was soaked in 100 ml of carbon tetrachloride, and subjected to ultrasonic treatment for 5 minutes to extract oil remaining on a surface of the test piece. The oil was analyzed with an infrared spectrophotometer to determine the amount of residual oil. As a result, the amount of residual oil was 67 μg/cm$^2$.

EXAMPLE 7

The cleaning test was conducted in the same manner as in Example 6 with the exception that a mixed solution of 70% by weight of 1,4-butanediol and 30% by weight of water was used as a degreasing cleaner. As a result, the amount of residual oil was 67 μg/cm$^2$.

EXAMPLE 8

The cleaning test was conducted in the same manner as in Example 6 with the exception that a mixed solution of 90% by weight of 1,4-butanediol and 10% by weight of water was used as a degreasing cleaner. As a result, the amount of residual oil was 54 μg/cm$^2$.

EXAMPLE 9

The cleaning test was conducted in the same manner as in Example 1 with the exception that 300 ml of a mixed solution of 80% by weight of 1-methoxy-2-butanol and 20% by weight of water was used as a degreasing cleaner. As a result, the amount of residual oil was 5 μg/cm$^2$.

EXAMPLE 10

The cleaning test was conducted in the same manner as in Example 9 with the exception that the test piece was cleaned at 60° C. at an air blowing rate of 0.2 Nl/min.cm$^2$ for 5 minutes. As a result, the amount of residual oil was 16 μg/cm$^2$.

COMPARATIVE EXAMPLES 1 TO 4

The cleaning tests were conducted in the same manner as in Example 1 with the exception that glycol-water mixed solutions having compositions shown in Table 1 were used as degreasing cleaners. Results thereof are shown in Table 1.

TABLE 1

| | Degreasing Cleaner | | | |
|---|---|---|---|---|
| | Main Component (wt %) | Water (wt %) | Third Component (wt %) | Amount of Residual Oil (μg/cm$^2$) |
| Example 1 | 1,2-Butanediol (80) | (20) | | 23 (Heat treatment oil) |
| Example 2 | 1,2-Butanediol (80) | (20) | | 15 (Cutting oil) |
| Example 3 | 1,2-Butanediol (30) | (30) | 1-Propoxy-2-butanol (40) | 6 (Cleaning temp. 60° C.) |
| Example 4 | 1,2-Butanediol (30) | (30) | 1-Propoxy-2-butanol (40) | 8 (Cleaning temp. 40° C.) |
| Example 5 | 1,2-Butanediol (30) | (20) | 1-Propoxy-2-butanol (50) | 4 (Cleaning temp. 60° C.) |
| Example 6 | 1,4-Butanediol (80) | (20) | | 67 |
| Example 7 | 1,4-Butanediol (70) | (30) | | 67 |

TABLE 1-continued

| | Degreasing Cleaner | | | |
|---|---|---|---|---|
| | Main Component (wt %) | Water (wt %) | Third Component (wt %) | Amount of Residual Oil (μg/cm$^2$) |
| Example 8 | 1,4-Butanediol (90) | (10) | | 54 |
| Example 9 | 1-Methoxy-2-butanol (80) | (20) | | 5 |
| Example 10 | 1-Methoxy-2-butanol (80) | (20) | | 16 (Air blowing 0.2 Nl/min · cm$^2$) |
| Comparative Example 1 | Propylene glycol (70) | (30) | | 360 |
| Comparative Example 2 | Dipropylene glycol (70) | (30) | | 163 |
| Comparative Example 3 | Ethylene glycol (70) | (30) | | 151 |
| Comparative Example 4 | Diethylene glycol (70) | (30) | | 200 |

EXAMPLE 11

A degreasing cleaner composed of a mixed solution of 70% by weight of 2-methyl-2,4-pentanediol and 30% by weight of water was placed in a 500-ml cleaning vessel having an air blowing pipe at a bottom portion thereof, and heated at 60° C.

A test piece made of chrome stainless steel (having a surface area of 33 cm$^2$) coated with 320 mg of heat treatment oil was soaked in the degreasing cleaner placed in the cleaning vessel, and air was blown therein at 0.2 Nl/min.cm$^2$ through the air blowing pipe. After 3 minutes, the test piece was taken out of the cleaning vessel, and air was blown thereon, followed by soaking in 300 ml of water for 1 minute. Then, the test piece after cleaning was soaked in 100 ml of carbon tetrachloride, and subjected to ultrasonic treatment for 5 minutes to extract oil remaining on a surface of the test piece. The oil was analyzed with an infrared spectrophotometer to determine the amount of residual oil. As a result, the amount of residual oil was 21 μg/cm$^2$.

EXAMPLES 12 and 13

The cleaning tests were conducted in the same manner as in Example 11 with the exception that mixed solutions of 2-methyl-2,4-pentanediol, 1-tert-butoxy-2-butanol and water having compositions shown in Table 2 were used as degreasing cleaners. Results thereof are shown in Table 2.

EXAMPLES 14 and 15

The cleaning tests were conducted in the same manner as in Example 11 with the exception that mixed solutions of 2-methyl-2,4-pentanediol, 1-propoxy-2-butanol and water having compositions shown in Table 2 were used as degreasing cleaners. Results thereof are shown in Table 2.

EXAMPLES 16 TO 18

The cleaning tests were conducted in the same manner as in Example 11 with the exception that mixed solutions of 1,2-hexanediol and water having compositions shown in Table 2 were used as degreasing cleaners. Results thereof are shown in Table 2.

EXAMPLES 19 TO 21

The cleaning tests were conducted in the same manner as in Example 11 with the exception that mixed solutions of butanediol and water having compositions shown in Table 2 were used as degreasing cleaners. Results thereof are shown in Table 2.

EXAMPLES 22 AND 23

The cleaning tests were conducted in the same manner as in Example 11 with the exception that mixed solutions of 1,2-butanediol, 1-propoxy-2-butanol and water having compositions shown in Table 2 were used as degreasing cleaners. Results thereof are shown in Table 2.

EXAMPLES 24 TO 26

The cleaning tests were conducted in the same manner as in Example 11 with the exception that mixed solutions of 1,2-butanediol, 1-tert-butoxy-2-butanol and water having compositions shown in Table 2 were used as degreasing cleaners. Results thereof are shown in Table 2.

COMPARATIVE EXAMPLES 5 TO 8

The cleaning tests were conducted in the same manner as in Example 11 with the exception that glycol-water mixed solutions having compositions shown in Table 2 were used as degreasing cleaners. Results thereof are shown in Table 2.

TABLE 2

| | Degreasing Cleaner | | | |
|---|---|---|---|---|
| | Main Component (wt %) | Water (wt %) | Third Component (wt %) | Amount of Residual Oil ($\mu g/cm^2$) |
| Example 11 | 2-Methyl-2,4-pentanediol (70) | (30) | | 21 |
| Example 12 | 2-Methyl-2,4-pentanediol (60) | (30) | 1-Tert-butoxy-2-butanol (10) | 4 |
| Example 13 | 2-Methyl-2,4-pentanediol (40) | (30) | 1-Tert-butoxy-2-butanol (30) | 1 |
| Example 14 | 2-Methyl-2,4-pentanediol (65) | (30) | 1-Propoxy-2-butanol (5) | 13 |
| Example 15 | 2-Methyl-2,4-pentanediol (50) | (30) | 1-Propoxy-2-butanol (20) | 5 |
| Example 16 | 1,2-Hexanediol (60) | (40) | | 16 |
| Example 17 | 1,2-Hexanediol (80) | (20) | | 8 |
| Example 18 | 1,2-Hexanediol (90) | (10) | | 7 |
| Example 19 | 1,2-Butanediol (70) | (30) | | 56 |
| Example 20 | 1,3-Butanediol (80) | (20) | | 287 |
| Example 21 | 1,4-Butanediol (80) | (20) | | 95 |
| Example 22 | 1,2-Butanediol (60) | (30) | 1-Propoxy-2-butanol (10) | 35 |
| Example 23 | 1,2-Butanediol (40) | (30) | 1-Propoxy-2-butanol (30) | 8 |
| Example 24 | 1,2-Butanediol (60) | (30) | 1-Tert-butoxy-2-butanol (10) | 48 |
| Example 25 | 1,2-Butanediol (50) | (30) | 1-Tert-butoxy-2-butanol (20) | 11 |
| Example 26 | 1,2-Butanediol (40) | (30) | 1-Tert-butoxy-2-butanol (30) | 2 |

TABLE 2-continued

| | Degreasing Cleaner | | | |
|---|---|---|---|---|
| | Main Component (wt %) | Water (wt %) | Third Component (wt %) | Amount of Residual Oil ($\mu g/cm^2$) |
| Comparative Example 5 | Propylene glycol (70) | (30) | | 878 |
| Comparative Example 6 | Dipropylene glycol (70) | (30) | | 396 |
| Comparative Example 7 | Ethylene glycol (70) | (30) | | 368 |
| Comparative Example 8 | Diethylene glycol (70) | (30) | | 489 |

EXAMPLE 27

A degreasing cleaner composed of a mixed solution of 80% by weight of 4-methyl-4-hydroxy-2-pentanone and 20% by weight of water was placed in a 500-ml cleaning vessel having an air blowing pipe at a bottom portion thereof, and heated at 60° C.

A test piece made of chrome stainless steel (having a surface area of 33 $cm^2$) coated with 320 mg of heat treatment oil was soaked in the degreasing cleaner placed in the cleaning vessel, and air was blown therein at 0.5 $Nl/min.cm^2$ through the air blowing pipe. After 10 minutes, the test piece was taken out of the cleaning vessel, and air was blown thereon, followed by soaking in 300 ml of water for 1 minute. Then, the test piece after cleaning was soaked in 100 ml of carbon tetrachloride, and subjected to ultrasonic treatment for 5 minutes to extract oil remaining on a surface of the test piece. The oil was analyzed with an infrared spectrophotometer to determine the amount of residual oil. As a result, the amount of residual oil was 21 $\mu g/cm^2$.

EXAMPLE 28

The cleaning test was conducted in the same manner as in Example 27 with the exception that the test piece was cleaned at a temperature of 40° C. As a result, the amount of residual oil was 21 $\mu g/cm^2$.

EXAMPLE 29

The cleaning test was conducted in the same manner as in Example 27 with the exception that a mixed solution of 70% by weight of 4-methyl-4-hydroxy-2-pentanone and 30% by weight of water was used as a degreasing cleaner. As a result, the amount of residual oil was 30 $\mu g/cm^2$.

EXAMPLE 30

The cleaning test was conducted in the same manner as in Example 27 with the exception that a mixed solution of 60% by weight of 4-methyl-4-hydroxy-2-pentanone and 40% by weight of water was used as a degreasing cleaner. As a result, the amount of residual oil was 35 $\mu g/cm^2$.

COMPARATIVE EXAMPLE 9

The cleaning test was conducted in the same manner as in Example 27 with the exception that a mixed solution of 80% by weight of 1-methoxyethanol and 20% by weight of water was used as a degreasing cleaner. As a result, the amount of residual oil was 46 $\mu g/cm^2$.

EXAMPLES 30 AND COMPARATIVE EXAMPLES 10 AND 11

Various resins shown in Table 3 were soaked in degreasing cleaners shown in Table 3 to evaluate the solubility of the resins. Results thereof are shown in Table 3.

The abbreviations used in Table 3 are as follows: 1,2BG, 1,2-butanediol; PBO, 1-propoxy-2-butanol; MMB, 3-methoxy-3-methyl-1-butanol; and NMP, N-methyl-2-pyrrolidone.

For each of the resins, the appearance and the shape were observed before and after soaking, and results of evaluation are shown in Table 3 as follows;

A: No changes before and after soaking

B: Slight changes are observed

C: Substantial changes are observed (i.e., changes in appearance due to dissolution or swelling are remarkable)

The results shown in Table 3 reveals that the degreasing cleaners of the present invention have low solubility to various resins and do little if any damage to the shape of resin parts.

TABLE 3

| | Example 30 | Comparative Example 10 | Comparative Example 11 |
|---|---|---|---|
| Composition of Degreasing Cleaner, Soaking Temp. and Time | PBO: 40 wt % 12BG: 30 wt % Water: 30 wt % 70° C., 6 hours | MMB: 80 wt % Water: 20 wt % 60° C., 5 hours | NMP: 80 wt % Water: 20 wt % 25° C., 24 hours |
| Polyethylene | A | A | A |
| Polypropylene | A | A | A |
| Polyacetal | A | A | C |
| Nylon-6 | A | B | C |
| Polystyrene | A | A | C |
| Polyvinyl Chloride | B | C | C |
| Epoxy Resin | A | C | C |
| Polyester | A | A | C |
| Polycarbonate | A | A | C |

EXAMPLE 31

A degreasing cleaner composed of a mixed solution of 80% by weight of 1,2-butanediol and 20% by weight of water was placed in a 500-ml cleaning vessel having an air blowing pipe at a bottom portion thereof, and heated at 60° C.

A material to be cleaned, a test piece made of chrome stainless steel (having a surface area of 33 $cm^2$) coated with 320 mg of heat treatment oil, was soaked in the degreasing cleaner placed in the cleaning vessel, and air was blown therein at 0.2 Nl/min.$cm^2$ through the air blowing pipe. After 3 minutes, the test piece was taken out of the cleaning vessel, and soaked in 300 ml of water for 1 minute. Then, the test piece after cleaning was soaked in 100 ml of carbon tetrachloride, and subjected to ultrasonic treatment for 5 minutes to extract oil remaining on a surface of the test piece. The oil was analyzed with an infrared spectrophotometer to determine the amount of residual oil. As a result, the amount of residual oil was 50 μg/$cm^2$.

EXAMPLE 32

The cleaning test was conducted in the same manner as in Example 31 with the exception that a degreasing cleaner composed of a mixed solution of 75% by weight of 1,2-butanediol, 20% by weight of water and 5% by weight of 4-methyl-4-hydroxy-2-pentanone was used. As a result, the amount of residual oil was 25 μg/$cm^2$.

EXAMPLE 33

The cleaning test was conducted in the same manner as in Example 31 with the exception that a degreasing cleaner composed of a mixed solution of 80% by weight of 1,2-butanediol and 20% by weight of water and 400 ppm by weight of sodium metasilicate based on the weight of the mixed solution was used. As a result, the amount of residual oil was 34 μg/$cm^2$.

EXAMPLE 34

The cleaning test was conducted in the same manner as in Example 31 with the exception that a degreasing cleaner composed of a mixture of 79.9% by weight of 1,2-butanediol, 20% by weight of water and 0.1% by weight of sodium metasilicate was used. As a result, the amount of residual oil was 21 μg/$cm^2$.

As described above in detail, the degreasing cleaners of the present invention can efficiently clean oil-deposited materials to be cleaned and provide good cleaned materials.

While the invention has been described in detail and with reference to specific embodiments thereof, it will be apparent to one skilled in the art that various changes and modifications can be made therein without departing from the spirit and scope thereof.

What is claimed is:

1. A degreasing cleaner composition consisting essentially of:

(A) 40 to 95% by weight based on total composition weight of a mixture of 35 to 90% by weight based on the total weight of the degreasing cleaner composition of (a) 1,2-butanediol, and 5 to 50% by weight based on the total weight of the degreasing cleaner composition of an alcoholic compound selected from (b) and (d), wherein (b) is a water soluble monoalkyl ether compounding with one hydrogen atom of hydroxyl groups of a water-soluble polyol having 4 to 10 carbon atoms and at least two hydroxyl groups is substituted by an alkyl group having 1 to 5 carbon atoms and (d) is 4-methyl-4-hydroxy-2-pentanone, and (B) 5 to 60% by weight based on the total composition weight of water.

2. A degreasing cleaner composition consisting essentially of:

(A) 40 to 95% by weight based on total composition weight of a mixture of 35 to 90% by weight based on the total weight of the degreasing cleaner composition of (a) 2-methyl-2,4-pentanediol and 5 to 50% by weight based on the total weight of the degreasing cleaner composition of an alcoholic compound selected from (b) 1-tert-butoxy-2-butanol and 1-propoxy-2-butanol, and (B) 5 to 60% by weight based on the total composition weight of water.

3. The degreasing cleaner composition according to claim 1, wherein ingredient (b) is at least one monoalkyl ether compound selected from the group consisting of 1-methoxy-2-butanol, 2-methoxy-1-butanol, 1-ethoxy-2-butanol, 2-ethoxy-1-butanol, 1-butoxy-2-butanol, 2-butoxy-1-butanol, 1-propoxy-2-butanol, 2-propoxy-1-butanol, 4-methyl-4-methoxy-2-pentanol, 4-methyl-4-ethoxy-2-pentanol and 4-methyl-4-propoxy-2-pentanol.

4. The degreasing cleaner composition of claim 1, wherein the alcoholic compound is selected from (b) 1-tert-butoxy-2-butanol and (d) 4-methyl-4-hydroxy-2-pentanone.

5. The degreasing cleaner composition according to claim 1, wherein said degreasing cleaner composition contains 0.01 to 1% by weight based on total composition weight of an alkali compound.

6. The degreasing cleaner composition according to claim 5, wherein said alkali compound is sodium metasilicate.

7. The degreasing cleaner composition according to claim 4, wherein said degreasing cleaner composition contains 0.01 to 1% by weight based on total composition weight of an alkali compound.

8. The degreasing cleaner composition according to claim 7, wherein said alkali compound is sodium metasilicate.

9. A method for cleaning a material having oil-deposited thereon to remove oil therefrom comprising contacting said material with a degreasing cleaner composition according to any one of claims 1, 2, 3, 4, 5, 6, 7, or 8.

10. The method according to claim 9, wherein the material cleaned is further washed with water or steam.

11. The method according to claim 9, wherein the oil-deposited material is cleaned with the degreasing cleaner composition, then gas is blown on said material to partially eliminate the cleaner deposited on the material, and subsequently the material is further washed with water or steam.

12. The method according to claim 9, wherein the material is cleaned with the cleaner composition at 40° to 80° C.

13. The method according to claim 11, wherein the gas blown on the material is a gas selected from the group consisting of air, nitrogen and carbon dioxide gas.

14. The method according to claim 10, wherein the material is washed with water at 40° to 80° C.

* * * * *